US007011083B2

(12) United States Patent
Ho et al.

(10) Patent No.: US 7,011,083 B2
(45) Date of Patent: Mar. 14, 2006

(54) PAINTBALL REFILLERS AND METHOD FOR MAKING AND USING SAME

(75) Inventors: Stephen Ho, Sugarland, TX (US); Kheng Phang, Sugarland, TX (US)

(73) Assignee: Avalon Advanced Products, Inc

( * ) Notice: Subject to any disclaimer, the term of this patent is extended or adjusted under 35 U.S.C. 154(b) by 0 days.

(21) Appl. No.: 10/429,922

(22) Filed: May 5, 2003

(65) Prior Publication Data

US 2004/0211403 A1 Oct. 28, 2004

Related U.S. Application Data

(63) Continuation-in-part of application No. 10/420,528, filed on Apr. 22, 2003.

(51) Int. Cl.
*F41B 11/02* (2006.01)

(52) U.S. Cl. ..... 124/45; 383/206

(58) Field of Classification Search ..... 124/45, 124/49; 383/42, 71, 203, 206
See application file for complete search history.

(56) References Cited

U.S. PATENT DOCUMENTS

| | | | | |
|---|---|---|---|---|
| 1,869,313 | A * | 7/1932 | Mackay | 229/87.05 |
| 2,684,807 | A * | 7/1954 | Gerrish | 383/206 |
| 2,983,430 | A * | 5/1961 | Taylor | 383/206 |
| 3,301,687 | A * | 1/1967 | Davy | 426/113 |
| 5,809,983 | A * | 9/1998 | Stoneking | 124/50 |
| 6,055,975 | A * | 5/2000 | Gallagher et al. | 124/50 |
| 6,234,157 | B1 * | 5/2001 | Parks | 124/45 |

* cited by examiner

*Primary Examiner*—John A. Ricci
(74) *Attorney, Agent, or Firm*—Robert W. Strozier

(57) ABSTRACT

A paintball hopper refill apparatus or loading apparatus is disclosed, which includes a body, an interior, a neck and a dispensing portion where the body is made of a flexible material, the interior is designed to be filled with a plurality of paintballs and the dispensing portion is designed to be opened either by pulling a pull string or by squeezing allowing the paintballs to flow from the loading apparatus to the hopper. A method for filling a hopper using the loading apparatus of this invention is also disclosed.

18 Claims, 10 Drawing Sheets

214
222
224
206
214
202
204
212
218
216
220
210
208
200
226
212

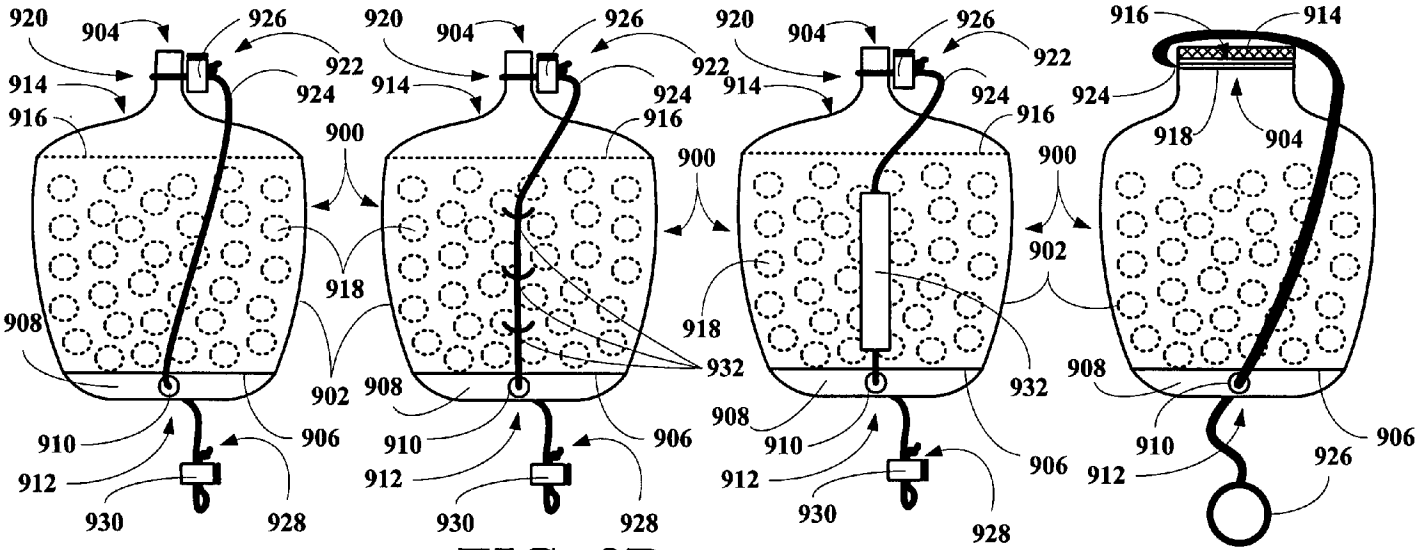
FIG. 9A
FIG. 9B
FIG. 9C
FIG. 9D
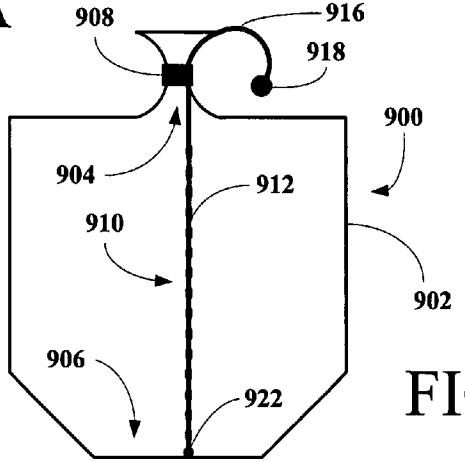
FIG. 9E

PAINTBALL REFILLERS AND METHOD FOR MAKING AND USING SAME

RELATED APPLICATIONS

This application is in a Continuation-in-Part to U.S. Original patent application Ser. No. 10/420,528 filed 22 Apr. 2003.

BACKGROUND OF THE INVENTION

1. Field of the Invention

The present invention relates to a paintball refiller apparatus and to method for using same.

More particularly, the present invention relates to a paintball refiner apparatus for paintball gun hoppers, where the refiner includes a bag having a pull member that when pulled opens a portion of the bag so that paintballs contained within the refiner fill up an interior of a paintball hopper. The present invention also relates to a method for filling a paintball hopper.

2. Description of the Related Art

Numerous types of paintball hoppers have been designed and developed and represent the vehicle by which a large number paintballs are supplied individually to a paintball gun through its feed tube. The most difficult part of using such hoppers is refilling them in the field. Generally, paintballs are sold in large bags or contains in lots of 500 or more. Typical hoppers on the other hand hold only between about 50 and 300. Thus, filling is a very hands on and messing operations. One attempt to circumvent this problem is the lighting loader disclosed in U.S. Pat. No. 5,809,983 to Stoneking. The Stoneking loader is a plastic device that couples with a specially designed hopper to allow paintballs to flow from the loader into the hopper. However, this solution only works for special hoppers and requires the user to carry a supply of these bulky loader tubes.

Thus, there is a need in the art for a simple, compact loader that can be used to load any type of hoppers easily and quickly.

SUMMARY OF THE INVENTION

The present invention provides a loader apparatus including a bag having a filler and a dispenser, where the bag comprises a flexible material, is capable of holding a plurality of paintballs and the dispenser is capable of being opened when the apparatus is placed inside a hopper of a paintball gun. One major benefit of the apparatus is that it makes hopper refilling during a game quicker and easier.

The present invention also provides a loader apparatus a bag including a neck, a body having a dispensing portion and an opener, where the bag comprises a flexible material and is capable of holding a plurality of paintballs, and the opener opens the dispenser when the apparatus is placed inside a hopper of a paintball gun.

The present invention also provides a method for loading a paintball hopper including the steps of opening a lid of a hopper and feeding a paintball dispensing end of a loading apparatus of this invention into an interior of the hopper accessed via an opening of the hopper exposed when the lid is opened. Once the loading apparatus is in the interior of the hopper, the opener is activated opening the dispensing portion of the loading apparatus. Once all the paintballs have exited the loading apparatus via the dispensing portion, the loading apparatus is removed and the lid closed. The paintball hopper is now loaded and firing can commence.

The present invention also provides a method for loading a paintball hopper including the steps of also provides a method for loading a paintball hopper including the steps of opening a lid of a hopper having a locking assembly in the locked position and feeding a paintball dispensing end of a loading apparatus of this invention into an interior of the hopper accessed via an opening of the hopper exposed when the lid is opened. Once the loading apparatus is in the interior of the hopper, the opener is activated opening the dispensing portion of the loading apparatus. Once all the paintballs have exited the loading apparatus via the dispensing portion, the loading apparatus is removed and the lid closed. After the lid is closed, the locking assembly of the hopper is set to an unlocked position so that paintballs can flow into the gun and firing can commence.

DESCRIPTION OF THE DRAWINGS

The invention can be better understood with reference to the following detailed description together with the appended illustrative drawings in Which like elements are numbered the same:

FIGS. 9A–C depict other preferred embodiments of a hopper loading apparatus of this invention; and FIG. 9D–E depict other preferred embodiments of a hopper loading apparatus of this invention.

DETAILED DESCRIPTION OF THE INVENTION

Figures 1A, 1B, 1C, 1D:
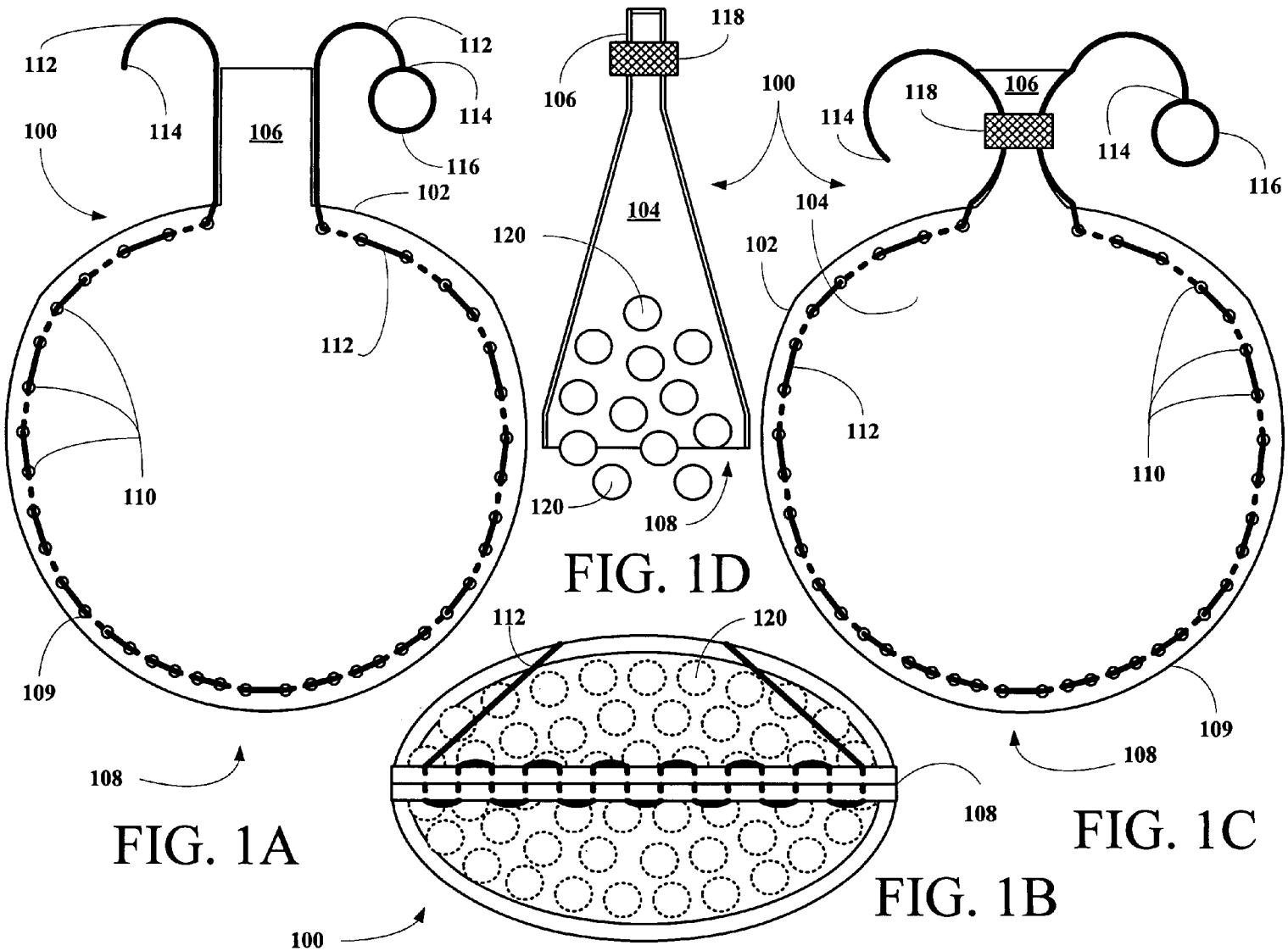
FIGS. 1A–D depict a preferred embodiment of a hopper loading apparatus of this invention.

The inventors have found that a paintball hopper loading apparatus can be constructed out of a flexible material with a dispensing portion, where the end of the apparatus having the dispensing portion is designed to be placed into the interior of the hopper and once inside the hopper, the dispensing portion is opened allowing a pre-determined number of paintballs contained in the loading apparatus to flow into the hopper. Because the loading apparatus is a light weight flexible material, it can be simply pocketed or discarded after paintball loading. Moreover, the flexible material allows the loading apparatus to be deformed for easy storage and so that the dispensing end can be easily fed into any type of opening in any type of hopper.

The present invention broadly relates to a hopper loading apparatus including body having an interior capable of receiving a pre-determined number of paintballs, a feeder adapted to receive the pre-determined number of paintballs, a dispensing portion adapted to be placed inside an interior of a paintball hopper and adapted to open allow the predetermined number of paintballs to fill the interior of the hopper quickly and easily even during a paintball game or exercise.

The present invention also broadly relates to a method for loading a paintball hopper including the steps of: placing a dispensing portion of a loading apparatus of this invention inside an interior of a paintball hopper. Once the dispensing portion of the loading apparatus is inside the hopper, the dispensing portion is opened and the paintballs are transferred from or allowed to flow out of the loading apparatus and into the hopper, filling the hopper. Once filled, a gun to which the hopper is connected is ready to use without having to disconnect the hopper or replace the hopper with a filled hopper.

All parts and components of the hopper loading apparatus can be constructed out of any flexible material including, without limitation, an elastomeric or rubber material, a plastic material (solid or open woven), a cloth material, a mesh or netting material, or any other flexible material or mixture or combinations thereof. Preferred flexible materials include, without limitation, elastomer or rubber films, polyolefin films, natural or synthetic cloth, and plastic or natural mesh material or mixture or combinations thereof Exemplary examples include latex rubber films, polyethylene films, polypropylene films, nylon films, polyester films, cotton cloth, canvas cloth, polyester cloth, nylon cloth, a Kevlar® cloth, or the like or mixture or combinations thereof. The pull string can be made out of any string material including natural and/or synthetic materials such as cotton, wool, Dacron, rayon, nylon, or the like or mixtures or combinations thereof The pull string can be solid (monofilament) or yam or of any other construction provided that the material does not break prior to opening the dispensing portion of the loaders of this invention.

Hopper Loading Apparatus

Referring now to FIGS. 1A–D, a preferred embodiment of a hopper loading apparatus of this invention, generally 100, is shown to include a body 102 having an interior 104 adapted to hold a plurality of paintballs 120 as shown in FIGS. 1B&D, a feeding neck 106 and a dispensing portion 108 that extends from the neck 106 around a contour 109 to the body 102. Thus, the body 102 comprises a closed neck and an open dispensing portion. The dispensing portion 108 includes a plurality of apertures 110 having a pull string 112 threaded therethrough as shown in an expanded end view in FIG. 1B, where the dispensing portion 108 is simply two pieces of material sown shut by the string 112. The apparatus 100 is shown as a squat cylindrical shape having rounded or dome shaped ends and to comprise a material having a thickness sufficient to hold the paintballs 120. Both ends 114 of the pull string 112 extend out past the neck 106. Preferably, one end 114 of the pull string 112 includes a pull ring 116 affixed thereto. After the apparatus 100 is filled with a predetermined number of paintballs, the neck 106 is crimped with a crimping member 118 so that the ends 114 extend out past the crimping member 118. The crimping member 118 is shown here as a band, but can be a twist tie, a zip tie, a velcro® tie or any other type of crimping member. The only criterion that the crimping member 118 needs to possess is the ability to hold the pull string 112 in place, but not so tight as to unduly restrict its movement so that the string 112 can be pulled free of the apparatus 100, opening the dispensing portion 108 and allowing the paintballs 120 to exit the apparatus 100 filing a hopper. The pull ring 116 is provided to aid the user in pulling the pull string 112 out of the apparatus 100 to dispense the paintballs. Thus, the body 102 comprises a neck 106 and an open dispensing portion 108 as shown in FIG. 1D (cross-sectional view) and once the ring 116 is pulled, the paintballs will exit the apparatus 100 as shown in FIG. 1D regardless of whether the string breaks or not, because the dispensing section 108 comprises the entire contour 109 of the body 102 except the neck 106.

Figures 2A, 2B, 2C:
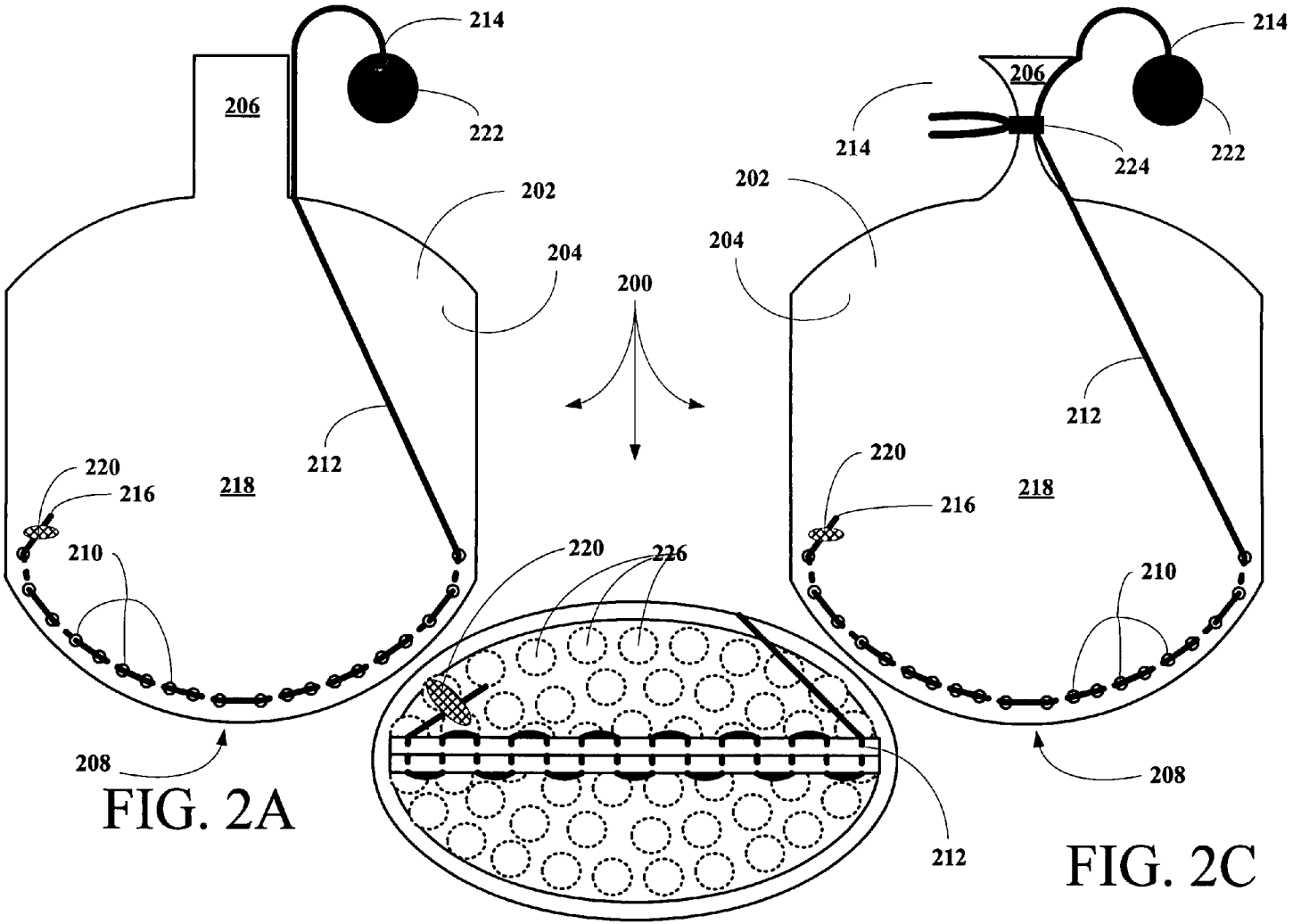
FIGS. 2A–C depict another preferred embodiment of a hopper loading apparatus of this invention.

Referring now to FIGS. 2A–C, another preferred embodiment of a hopper loading apparatus of this invention, generally 200, is shown to include a body 202 having an interior 204 adapted to hold a plurality of paintballs 226 as shown in FIG. 2B, a feeding neck 206 and a dispensing portion 208 located opposite the neck 206. The dispensing portion 208 includes a plurality of apertures 210 having a pull string 212 threaded therethrough as shown in an expanded end view in FIG. 2B, where the dispensing portion 208 is opened and sown shut by the string 212. The apparatus 200 is shown as a squat cylinder shape having rounded or dome shaped ends and to comprise a material having a thickness sufficient to hold the paintballs 226. One end 214 of the pull string 212 extend out past the neck 206, while the other end 216 is loosely attached to an outer surface 218 of the apparatus 200 by an attachment member 220. Preferably, the end 214 of the pull string 212 includes a pull tab 222 affixed thereto. The attachment member 220 can be an adhesive patch or a low surface tension patch where the adhesive or cohesive interaction with the surface 218 of the apparatus 200 is sufficiently weak to allow the string 212 to be pulled free of the member 220.

After the apparatus 200 is filled with a pre-determined number of paintballs 226, the neck 206 is crimped with a crimping member 224 so that the end 214 extend out past the crimping member 224. The crimping member 224 is shown here as a twist tie, but can be a band, a zip tie, a velcro® tie or any other type of crimping member. The only criterion that the crimping member 224 needs to possess is that ability to hold the pull string 212 in place, but not so tight as to unduly restrict its movement so that the string 212 can be pulled free of the apparatus 200 opening the dispensing portion 208 and allowing the paintballs 226 to exit the apparatus 200 filing a hopper.

Figures 3A, 3B, 3C:
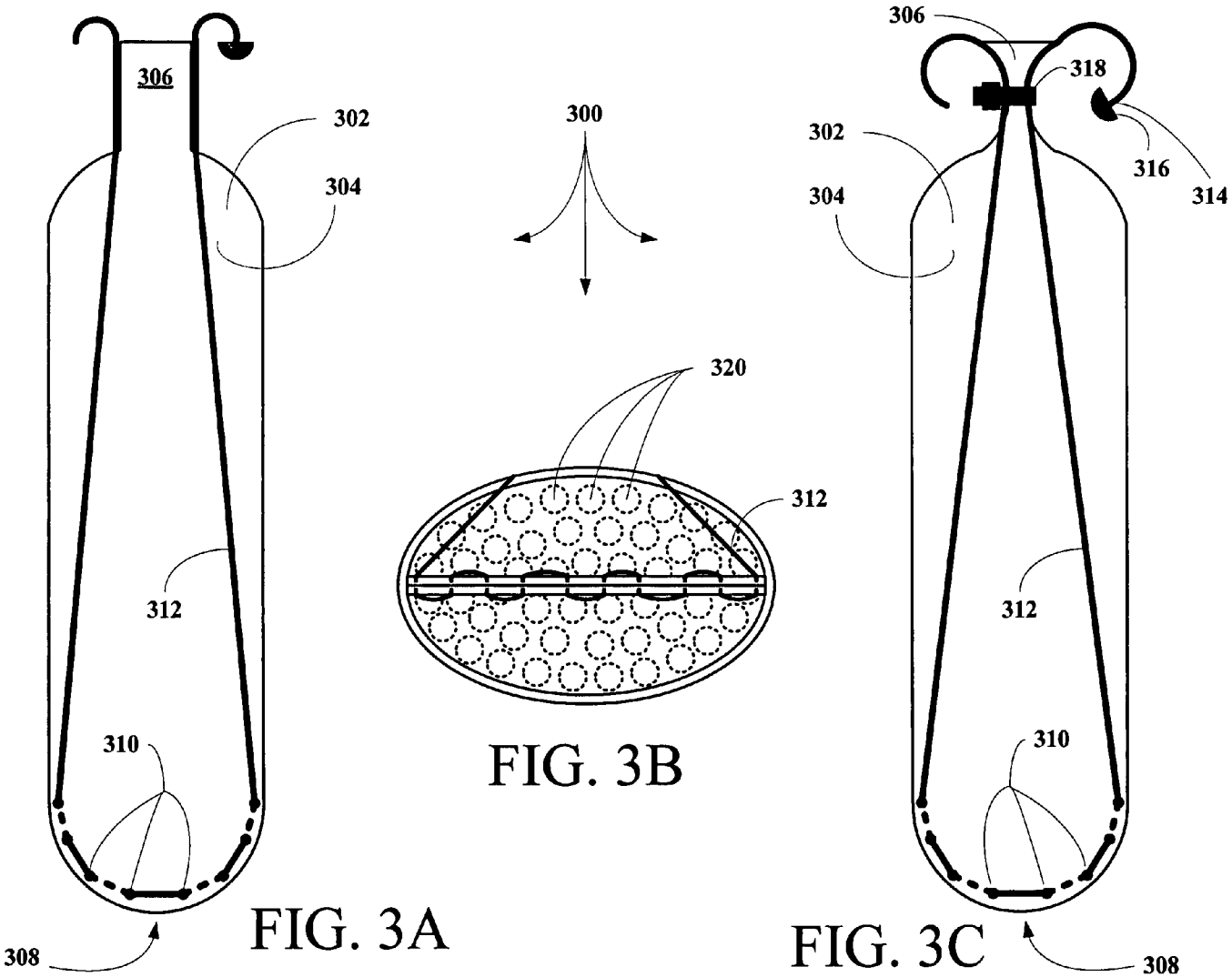
FIGS. 3A–C depict another preferred embodiment of a hopper loading apparatus of this invention.

Referring now to FIGS. 3A&B, another preferred embodiment of a hopper loading apparatus of this invention, generally 300, is shown to include a body 302 having an interior 304 adapted to hold a plurality of paintballs 320 as shown in FIG. 3B, a feeding neck 306 and a dispensing portion 308 located opposite the neck 306. The dispensing portion 308 includes a plurality of apertures 310 having a pull string 312 threaded therethrough as shown in an expanded end view in FIG. 3B. Both ends 314 of the pull string 312 extend out past the neck 306. Preferably, one end 314 of the pull string 312 includes a pull tab 316 affixed thereto. The apparatus 300 is shown as an elongated cylinder shape having rounded or dome shaped ends and to comprise a material having a thickness sufficient to hold the paintballs 320. After the apparatus 300 is filled with a pre-determined number of paintballs 320, the neck 306 is crimped with a crimping member 318 so that the ends 314 extend out past the crimping member 318. The crimping member 318 is shown here as a zip tie, but can be a twist tie, a band, a velcro® tie or any other type of crimping member. The only criterion that the crimping member 318 needs to possess is that ability to hold the pull string 312 in place, but not so tight as to unduly restrict its movement so that the string 312 can be pulled free of the apparatus 300 opening the dispensing portion 308 and allowing the paintballs to exit the apparatus 300 filing a hopper.

Figures 4A, 4B:
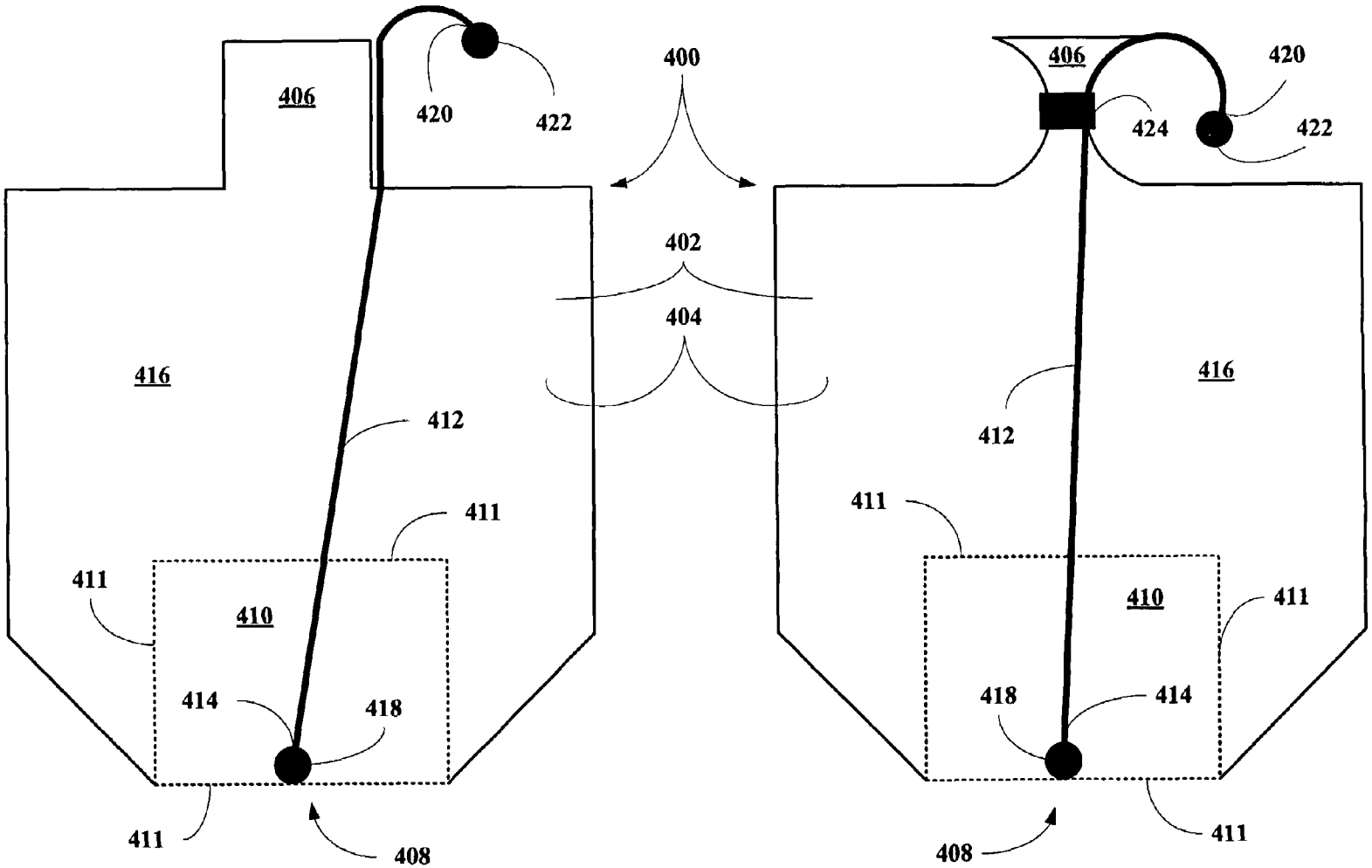
FIGS. 4A–B depict another preferred embodiment of a hopper loading apparatus of this invention.

Referring now to FIGS. 4A–C, another preferred embodiment of a hopper loading apparatus of this invention, generally 400, is shown to include a body 402 having an interior 404 adapted to hold a plurality of paintballs (not shown), a feeding neck 406 and a dispensing portion 408 located opposite the neck 406. The dispensing portion 408 includes a perforated flap 410 having perforated lines 411 a pull string 412 attached at a first end 414 to an outer surface 416 of the apparatus 400 by an attachment member 418. The perforated lines 411 are designed to allow the flap 410 to be torn away from the body 402 forming an opening through which the paintballs can exit the interior 404 of the apparatus 400. The attachment member 418 is generally an adhesive dot used to fix the end 414 to the outer surface 416 of the body 402. A second end 420 of the pull string 412 extend out past the neck 406. Preferably, the end 420 of the pull string 412 includes a pull tab 422 affixed thereto. After the apparatus 400 is filled with a predetermined number of paintballs (not shown), the neck 406 is crimped with a crimping member 424 so that the end 420 extend out past the crimping member 424. The crimping member 424 is shown here as a velcro® tie, but can be a twist tie, a band, a zip tie, or any other type of crimping member. The only criterion that the crimping member 424 needs to possess is that ability to hold the pull string 412 in place, but not so tight as to unduly restrict its movement so that the string 412 can be pulled free of the apparatus 400 opening the dispensing portion 408 and allowing the paintballs to exit the apparatus 400 filing a hopper. The apparatus 400 is ship shaped and is composed of a material having sufficient thickness and strength to hold the paintballs.

Figures 5A, 5B, 5C:
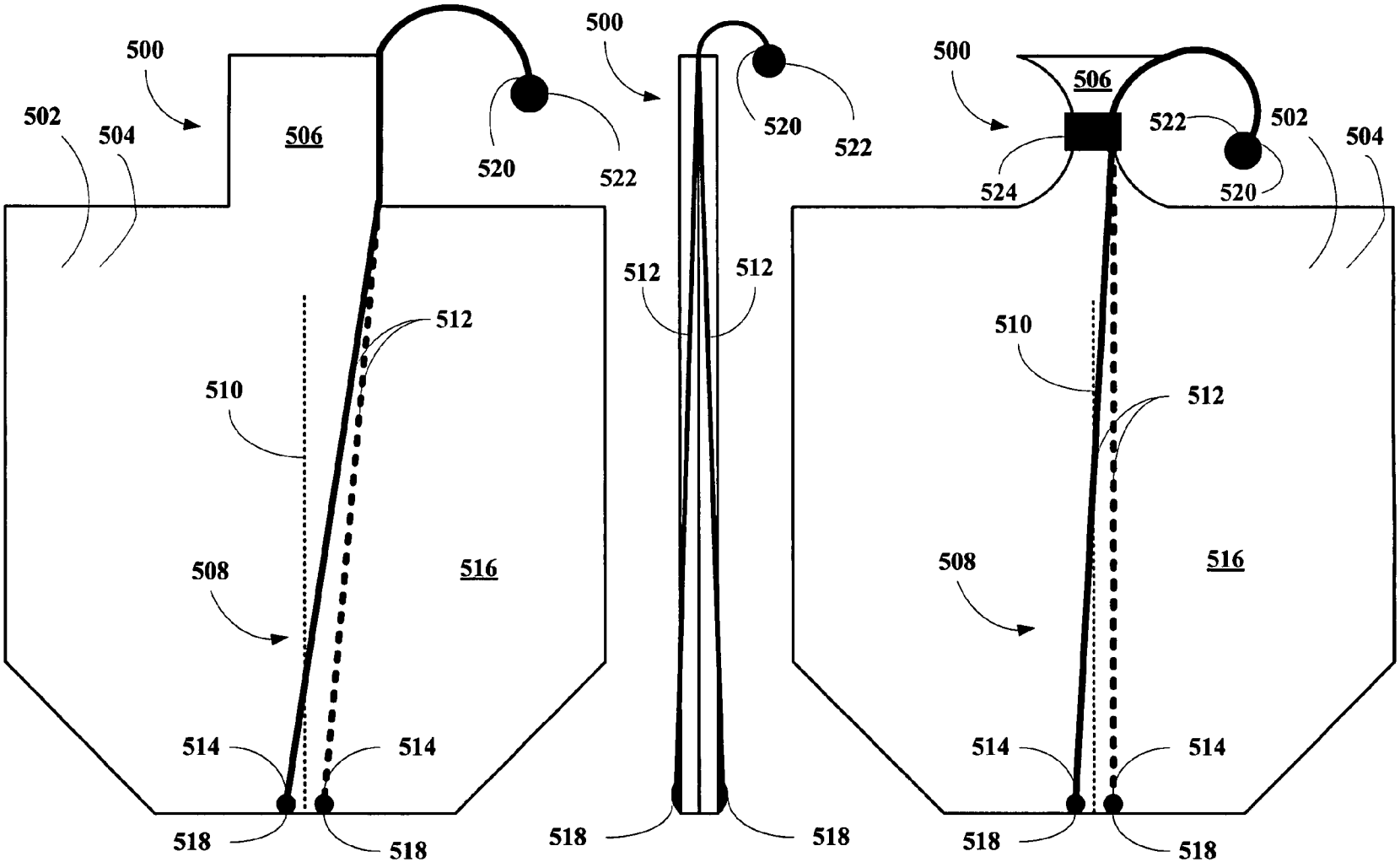
FIGS. 5A–C depict another preferred embodiment of a hopper loading apparatus of this invention.

Referring now to FIGS. 5A–C, another preferred embodiment of a hopper loading apparatus of this invention, generally 500, is shown to include a body 502 having an interior 504 adapted to hold a plurality of paintballs (not shown), a feeding neck 506 and a dispensing portion 508 located opposite the neck 506. The dispensing portion 508 includes a vertical perforated line 510 having pull strings 512 attached at first ends 514 to an outer surface 516 of the apparatus 500 by attachment members 518 on either side of the line 510 as shown in an expanded end view in FIG. 5B. The perforated line 510 is designed to allow the body 502 to be torn open along the line 510 forming an opening through which the paintballs can exit the interior 504 of the apparatus 500. The attachment members 518 are generally an adhesive dot used to fix the ends 514 to the outer surface 516 of the body 502. Second ends 520 of the pull string 512 extend out past the neck 506. Preferably, the ends 520 of the pull strings 512 are affixed to a pull tab 522. After the apparatus 500 is filled with a predetermined number of paintballs (not shown), the neck 506 is crimped with a crimping member 524 so that the ends 514 extend out past the crimping member 524. The crimping member 524 is shown here as a band, but can be a twist tie, a zip tie, or any other type of crimping member. The only criterion that the crimping member 524 needs to possess is that ability to hold the pull strings 512 in place, but not so tight as to unduly restrict its movement so that the strings 512 can be pulled free of the apparatus 500 opening the dispensing portion 508 and allowing the paintballs to exit the apparatus 500 filing a hopper. The apparatus 500 is ship shaped and is composed of a material having sufficient thickness and strength to hold the paintballs.

Figures 6A, 6B, 6C:
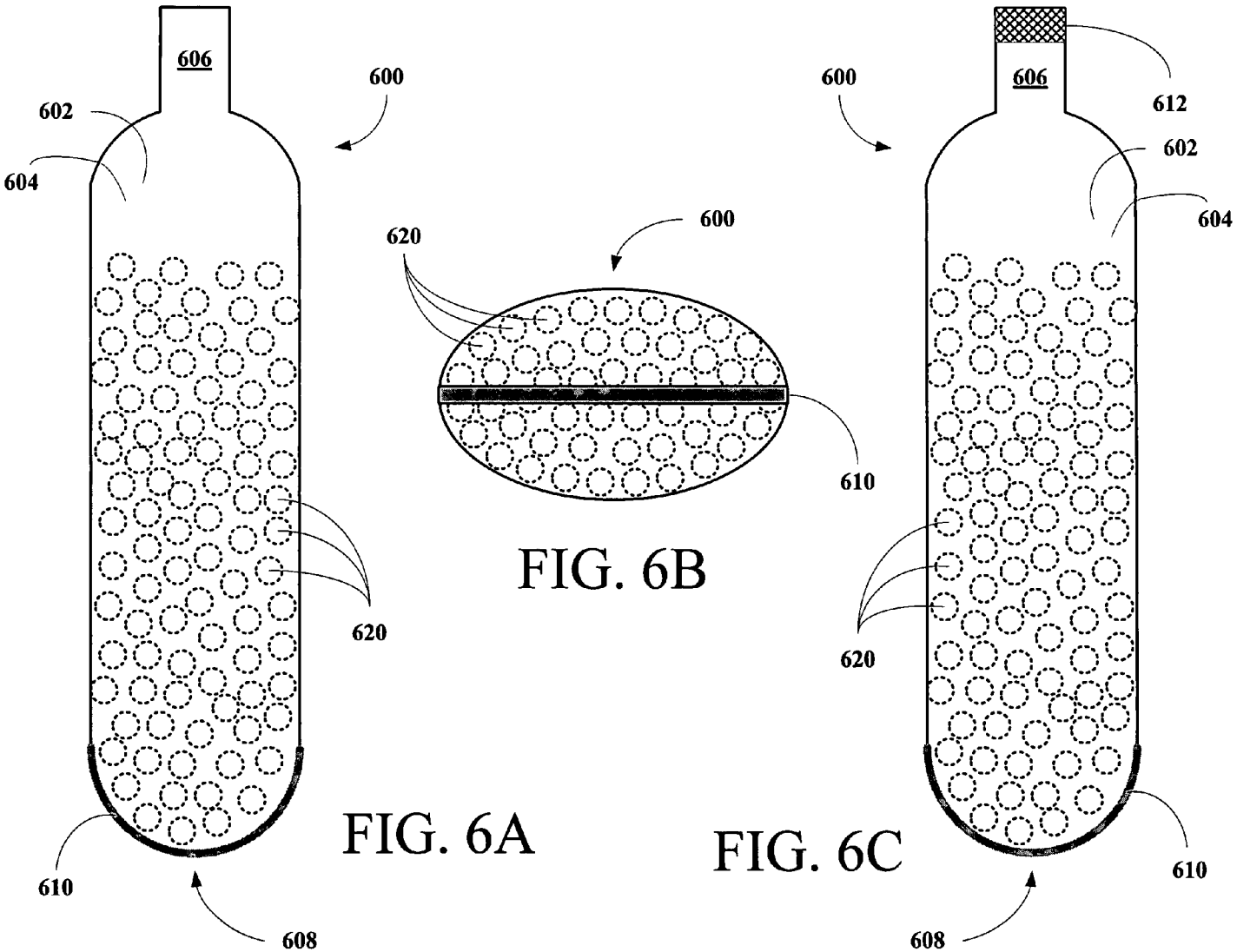
FIGS. 6A–C depict another preferred embodiment of a hopper loading apparatus of this invention.

Referring now to FIGS. 6A–C, another preferred embodiment of a hopper loading apparatus of this invention, generally 600, is shown to include a body 602 having an interior 604 adapted to hold a plurality of paintballs 620, a feeding neck 606 and a dispensing portion 608 located opposite the neck 606. The dispensing portion 608 comprises a weakened air tight seam 610. After the apparatus 600 is filled with a pre-determined number of paintballs 620, the neck 606 is sealed in an air tight manner by seal 612 so that the interior 604 includes a volume of gas 614 above and surrounding the paintballs 620. Once the dispensing portion 608 is placed in the interior of a hopper, the apparatus is simply squeezed at its neck end 614 with sufficient pressure to rupture the seam 610 forming an opening through which the paintballs 620 can exit the apparatus 600 filling the hopper.

The hopper loading apparatuses of this invention can be of any shape and/or any size. However, generally, the hopper loading apparatuses of this invention are sized to hold between about 50 and about 300 paintballs depending on the size of the hopper to be filled. Preferably, the hopper loading apparatus of this invention are sized to hold between about 100 and about 300 paintballs with sizes for 100, 150, 200, 250, and 300 paintballs being particularly preferred. Moreover, the necks of the apparatuses can be reinforced to aid apparatus filling. The apparatuses are designed to be manually and preferably automatically filled. Preferably, the apparatuses are held in an filling machine at the paintball manufacturers facility, where a predetermined number of paintballs are loaded into the loading apparatus. After filling the apparatus with paintballs, the crimping member is attached to the loading apparatus, and the loading apparatuses are ready for shipment to vendors. One main advantage of the apparatuses of this invention is that the paintballs do not ever come in contact with humans and minimally contact the environment limiting damage to the paintballs through contact.

Method of Loading a Paintball Hopper

Figures 7A, 7B, 7C:
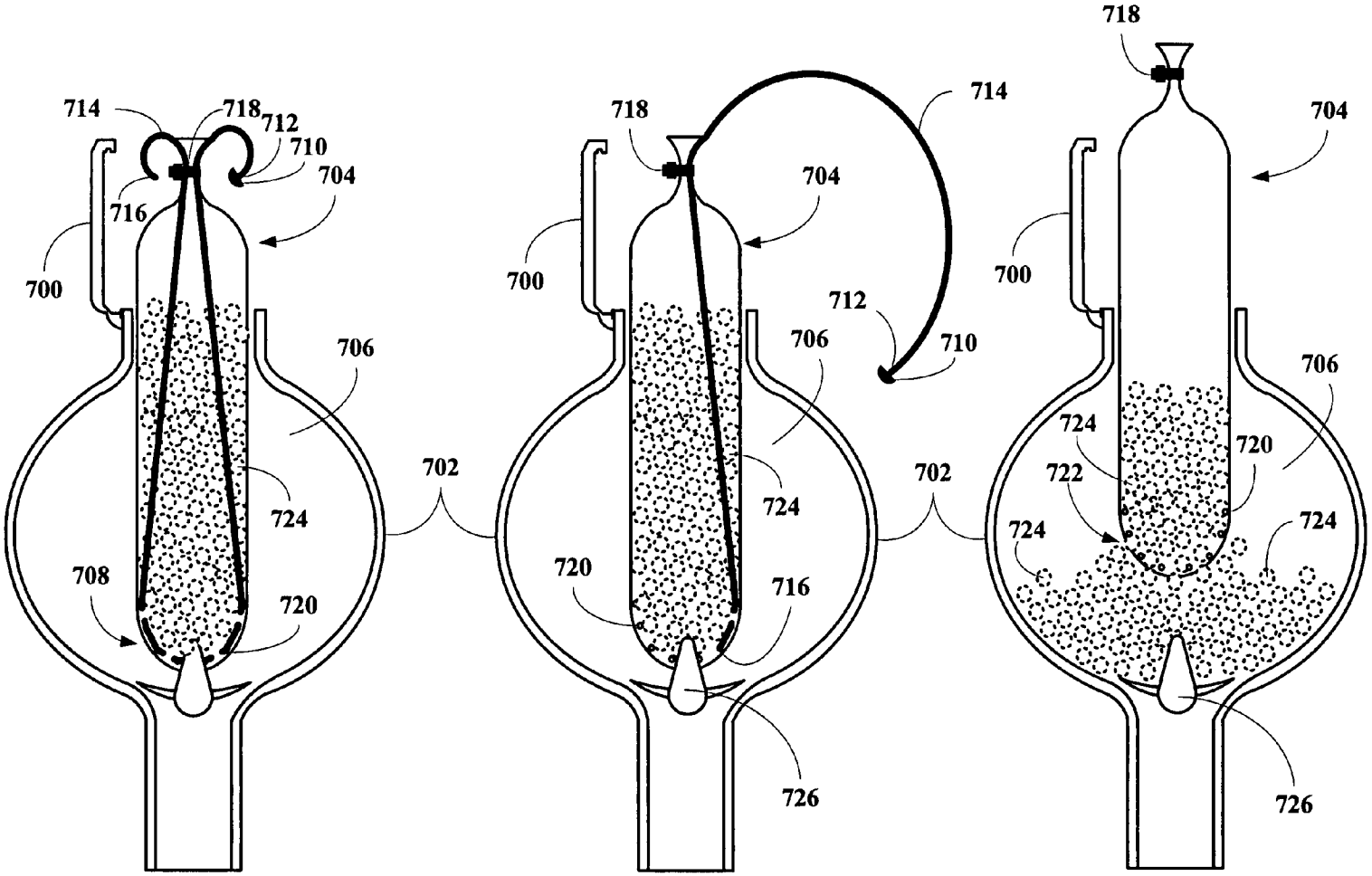
FIGS. 7A–C depict a method for loading a hopper with a hopper loading apparatus of this invention.

Referring now to FIGS. 7A–C, a preferred method for filling a paintball hopper is illustrated. A lid 700 of a hopper 702 is opened and a loading apparatus 704 of this invention is inserted into an opening 706 of the hopper 702 so that a dispensing portion 708 of the loading apparatus 704 is within an interior 706 of the hopper 702 as shown in FIG. 7A. Once the dispensing portion 708 of the apparatus 704 is positioned in the interior 706 of the hopper 702, the user pulls on a tab 710 (half moon shaped here) affixed to a first end 712 of a pull string 714 pulling a second string end 716 through a zip tie crimping member 718 and through threading apertures 720. Continuing the pulling operation, unzips the dispensing portion 708 forming an opening 722 through which a pre-determined number of paintballs 724 fill the interior 706 of the hopper 702 shown here with a locking assembly 726. After the paintballs 724 have been transferred from the loader 704 to the hopper 702, the loader 704 can be discharged and the lid 700 shut. If the hopper 702 is attached to a paintball gun, then the locking assembly 726 can be either in the open or closed position, while if the hopper 702 is not attached to a paintball gun, then the locking assembly 726 should be in the locked position. However, for locking type hoppers, loading should preferably occur with the locking assembly in the closed position. For non-locking hoppers, loading should occur only when the hopper is attached to a paintball gun to minimize paintball loss.

Figures 8A, 8B, 8C, 8D, 8E:
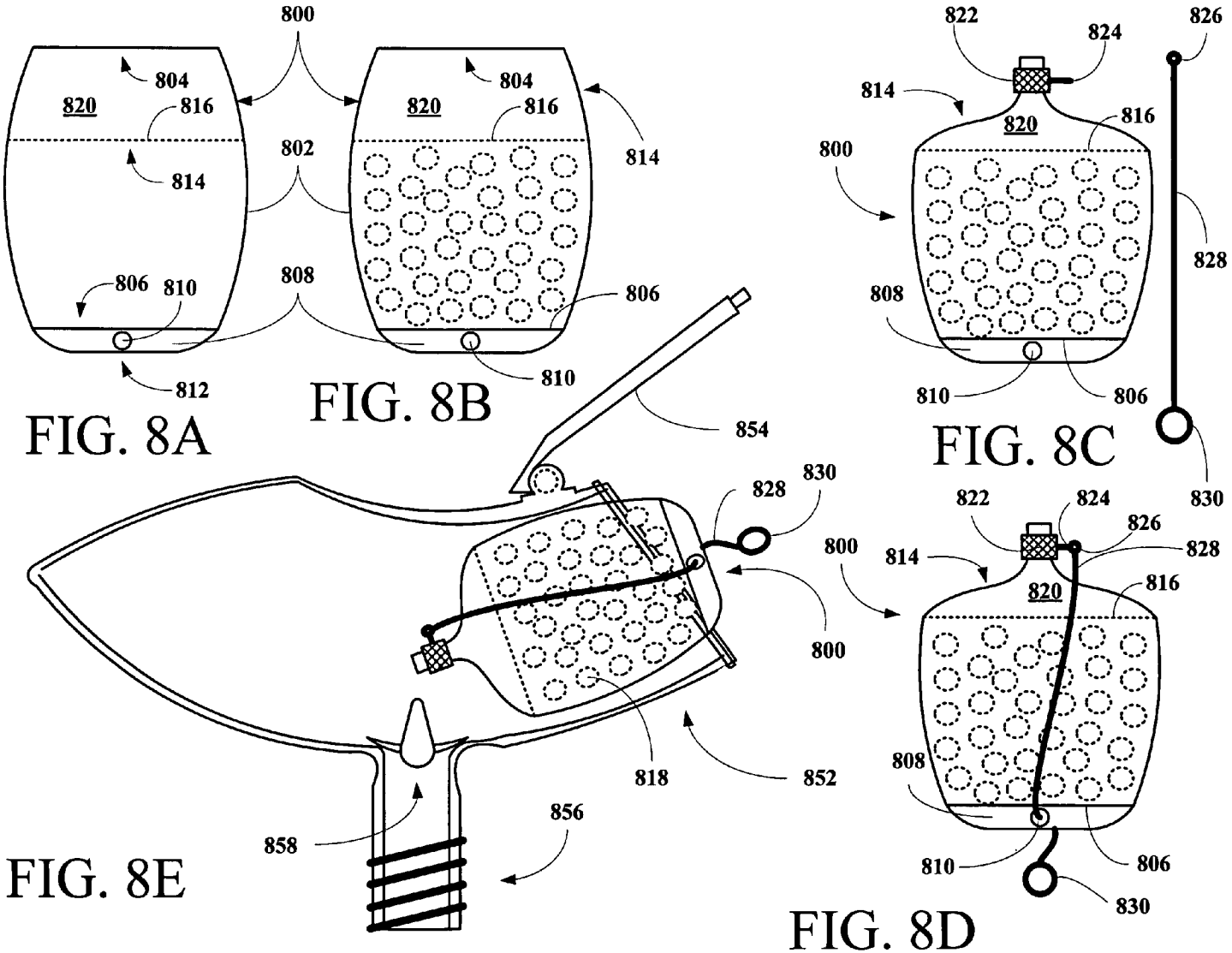
FIGS. 8A–H depict a method for making another preferred embodiment of a hopper loading apparatus of this invention and for loading a hopper with the hopper loading apparatus.
Figures 8F, 8G, 8H:
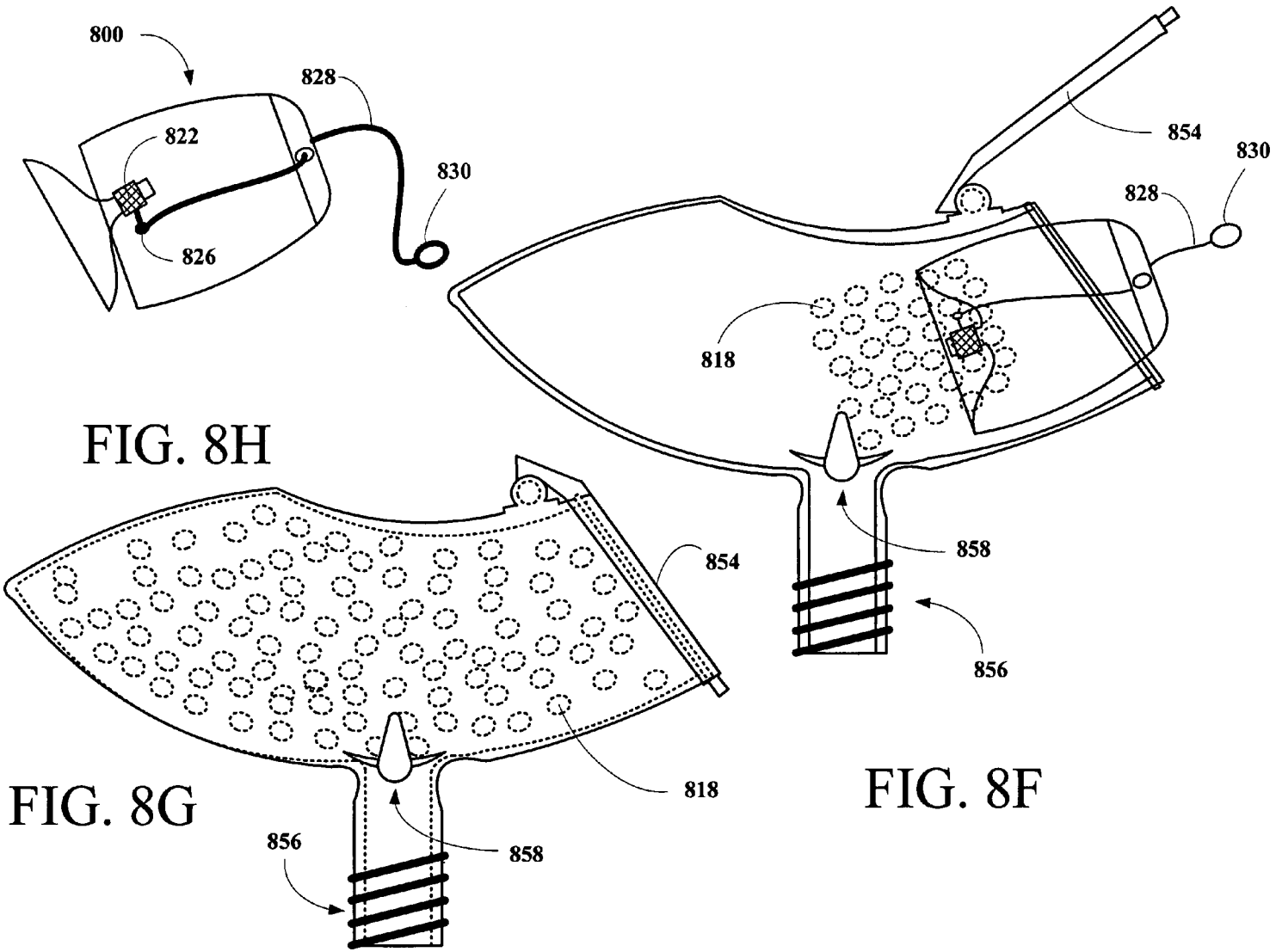

Method of Making a Preferred Loading Apparatus and of Loading a Paintball Hopper Referring now to FIGS. 8A–D, a preferred hopper loading apparatus and a preferred method for making a hopper loading apparatus of this invention are illustrated. Looking at FIG. 8A, an unfilled loader 800 is shown to include a body 802 having an opened end 804, and a closed end 806, where the closed end 806 includes a double ply area 808 having an aperture 810 in a central regions 812 thereof. The body 802 also includes a dispensing portion 814 comprising a weakened line or tear seam 816. Looking at FIG. 8B, the loader 800 is shown filled with paintballs 818. Again, the number of paintballs 818 can vary from about 50 to about 300, with lesser and greater numbers being possible, but not preferred. Once filled with the paintballs 818, a portion 820 of the body 802 above the tear line 816 is gathered and bound by a crimping member 822 having a line attachment tab 824. The line attachment tab 824 is designed to be affixed to a pull string connector 826 of a pull string 828 having a pull ring 830 at this opposite end. The connector 826 of the pull string 828 is threaded through the aperture 810 and connected to the tab 824 as shown in FIG. 8D to form the finished loader 800. The connection can be thermal melting of the tab 824 and the connector 826, inserting the tab 824 into the connector 826 and pushing the connector closed, or any other connecting means that will affix the tab 824 to the pull string 828.

Referring now to FIGS. 8E–H, a preferred method for filling a paintball hopper is illustrated. The loader 800 is inserted into an opened end 850 of a hopper 852 including a lid 854 (shown opened), a threaded neck 856 and a closing assembly 858 as shown in FIG. 8E. Once the loader 800 has been inserted into the interior of the hopper 852, the pull ring 830 is pulled while holding the loader closed end 806, causing the loader 800 to rupture along its seam 816 releasing the paintballs 818 into the hopper 852, as show in FIG. 8F. After the paintballs 818 have been loaded into the hopper 852, the empty torn loader 800 is removed and the lid 854 is closed. The hopper 852 is now loaded. All the loading operation can be done with a disconnected hopper or with the hopper connected to a paintball gun depending on whether the hopper has a closing assembly. Because all of the loaders and the loading methods of this invention are so simple that the user can load hopper anywhere and the empty, torn loader can be discarded or put in a pocket for recycling.

Additional Preferred Loading Apparatuses

Referring now to FIGS. 9A–C, three other preferred loaders 900 of this invention are shown. Looking a FIG. 9A, the loader 900 includes a body 902 having an opened end 904, and a closed end 906, where the closed end 906 includes a double ply area 908 having an aperture 910 in a central regions 912 thereof. The body 902 also includes a dispensing portion 914 comprising a weakened line or tear seam 916. The loader 900 is shown filled with paintballs 918. Again, the number of paintballs 918 can vary from about 50 to about 300, with lesser and greater numbers being possible, but not preferred. A portion 920 of the body 902 above the tear line 916 is gathered and bound by a first end portion 922 of a pull string 924 and then attached to a thumb unlocking connector 926. The pull string 924 is then threaded through the aperture 910 and a second end portion 928 is then attached to a second thumb unlocking connector 930.

Referring Looking a FIG. 9B, the loader 900 includes a body 902 having an opened end 904, and a closed end 906, where the closed end 906 includes a double ply area 908 having an aperture 910 in a central regions 912 thereof. The body 902 also includes a dispensing portion 914 comprising a weakened line or tear seam 916. The loader 900 is shown filled with paintballs 918. Again, the number of paintballs 918 can vary from about 50 to about 300, with lesser and greater numbers being possible, but not preferred. A portion 920 of the body 902 above the tear line 916 is gathered and bound by a first end portion 922 of a pull string 924 and then attached to a unlocking thumb connector 926. The pull string 924 is then threaded through a set of guides 932 and the aperture 910. A second end portion 928 is then attached to a second thumb connector 930.

Referring Looking a FIG. 9C, the loader 900 includes a body 902 having an opened end 904, and a closed end 906, where the closed end 906 includes a double ply area 908 having an aperture 910 in a central regions 912 thereof. The body 902 also includes a dispensing portion 914 comprising a weakened line or tear seam 916. The loader 900 is shown filled with paintballs 918. Again, the number of paintballs 918 can vary from about 50 to about 300, with lesser and greater numbers being possible, but not preferred. A portion 920 of the body 902 above the tear line 916 is gathered and bound by a first end portion 922 of a pull string 924 and then attached to a unlocking thumb connector 926. The pull string 924 is then threaded through a guide channel 932 and the aperture 910. A second end portion 928 is then attached to a second thumb connector 930.

Referring now to FIG. 9D, another preferred loader 900 of this invention is shown to include a body 902 having a sealed opened end 904, and a closed end 906, where the closed end 906 includes a double ply area 908 having an aperture 910 in a central regions 912 thereof and the open end 904 includes a seal 914. The body 902 also includes a dispensing portion 916 comprising a weakened portion or tear seam 918, located just below the seal 914. The loader 900 is shown filled with paintballs 920. Again, the number of paintballs 918 can vary from about 50 to about 300, with lesser and greater numbers being possible, but not preferred. A pull string 922 is threaded through the aperture 910 and a knife end 924 of the pull string 922 is positioned adjacent the weakened portion or seam 916. The pull string 922 includes a pull ring 926 at its opposite side. When the ring 926 is pulled, the knife end 924 tears the loader 900 opened along the weakened seam 916.

Referring now to FIG. 9E, another preferred loader 900 of this invention is shown to include a body 902 having a crimped opened end 904 and a closed end 906, where the opened end 904 is crimped by a crimping member 908, shown here as a band. The body 902 also includes a dispensing portion 910 comprising a weakened seam 912. The loader 900 can be filled with paintballs. Again, the number of paintballs 918 can vary from about 50 to about 300, with lesser and greater numbers being possible, but not preferred. A pull string 916 having a pull tab 918 at one end 920 is threaded through the band 908, extends through an aperture 922 located near the closed end 906 and is laminated to an inner surface of an interior of the body 902 along the seam 912. When pulled by the tab 918, the string or rip cord 916 tears the loader 900 opened long the seam 912 releasing the paintballs.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method for filling a paintball hopper comprising the steps of:

providing a hopper loader comprising a flexible bag including an interior, a dispensing portion, and an opener, where the interior is filled with a plurality of paintballs;

inserting the loader into the a paintball hopper so that the dispensing portion is situated within an interior of the hopper;

pulling the opener to open the dispensing portion of the loader, and transferring the paintballs from the loader to the interior of the hopper.

2. The method of claim 1, further including a crimping member adapted to crimp the dispensing portion of the apparatus.

3. The method of claim 1, wherein the plurality of paintballs is a pre-determined number of paintballs.

4. The method of claim 3, wherein the pre-determined number of paintballs is between about 50 and about 300.

5. The method of claim 3, wherein the pre-determined number of paintballs is 100, 150, 200, 250 or 300.

6. The loader method of claim 1, wherein the flexible material is selected from the group consisting of a film, a cloth, a mesh and a combination thereof.

7. The method of claim 1, further comprising the step of:

removing the loader from the hopper.

8. A paintball hopper loader bag comprising:

an open top end including:

a crimping member having:

an attachment member, a closed bottom end including:

an aperture in a center portion thereof, an interior including:

a plurality of paintballs, a dispensing portion disposed on a top portion of the bag, and an opener comprising:

a pull string including:

a connector affixed to or integral with its proximal end, and a pull member affixed to or integral with its distal end, where the pull string passes through the aperture in the closed end and the connector is attached or affixed to the attachment member of the crimping member so that when the pull string pull member is pulled, the dispensing portion is opened allowing the paintballs to exit the bag and where all components of the bag remains connected together for easy disposal.

9. The bag of claim 8, wherein the pull member is a ring or tab.

10. The bag of claim 8, the bag comprises a flexible material.

11. The bag of claim 10, wherein the flexible material is selected from the group consisting of a film, a cloth, a mesh and a combination thereof.

12. The bag of claim 8, the dispensing portion comprises a weakened line or a tear seam.

13. The bag of claim 8, wherein the pull string is solid.

14. A paintball loader bag comprising:

an open top end including:

a crimping member having:

an attachment member, a closed bottom end including:

an aperture in a center portion thereof, an interior including:

a pre-determined number of paintballs, a dispensing portion disposed on a top portion of the bag, and an opener comprising:

a pull string including:

a connector affixed to or integral with its proximal end, and a pull member affixed to or integral with its distal end, where the pull string passes through the aperture in the closed end and the connector is attached or affixed to the attachment member of the crimping member so that when the pull string pull member is pulled, the dispensing portion is opened allowing the paintballs to exit the bag and where all components of the bag remains connected together for easy disposal.

15. The bag of claim 14, wherein the bag comprises a flexible material.

16. The bag of claim 15, wherein the flexible material is selected from the group consisting of a film, a cloth, a mesh and a combination thereof.

17. The loader of claim 14, wherein the pre-determined number of paintballs is between about 50 and about 300.

18. The loader of claim 14, wherein the pre-determined number of paintballs is 100, 150, 200, 250 or 300.

* * * * *